United States Patent [19]

Otsuka

[11] Patent Number: 4,709,229

[45] Date of Patent: Nov. 24, 1987

[54] FIRE DETECTOR

[75] Inventor: Hidenori Otsuka, Ibaraki, Japan

[73] Assignee: Nohmi Bosai Kogyo Co., Ltd., Tokyo, Japan

[21] Appl. No.: 833,893

[22] Filed: Feb. 26, 1986

[30] Foreign Application Priority Data

Feb. 27, 1985 [JP] Japan ..... 60-38371
Feb. 27, 1985 [JP] Japan ..... 60-38372

[51] Int. Cl.[4] ..... G08B 17/00; G08B 17/06; G08B 17/10

[52] U.S. Cl. ..... 340/540; 340/529; 340/577; 340/587; 340/628

[58] Field of Search ..... 340/587, 577, 628, 530, 340/529, 691, 540

[56] References Cited

U.S. PATENT DOCUMENTS 3,257,653 6/1966 McCorkindale ..... 340/529
4,123,656 10/1978 Kajii ..... 340/529
4,151,522 4/1979 Yamauchi ..... 340/587
4,249,168 2/1981 Muggli ..... 340/587
4,524,351 6/1985 Kimura et al. ..... 340/628

FOREIGN PATENT DOCUMENTS 0098554 1/1983 European Pat. Off. .
2230934 2/1973 Fed. Rep. of Germany .
2728309 1/1979 Fed. Rep. of Germany .

*Primary Examiner*—Glen R. Swann, III
*Attorney, Agent, or Firm*—Brumbaugh Graves Donohue & Raymond

[57] ABSTRACT

Fire detection apparatus includes a fire detector panel and an accumulation-type control panel in which the fire detection element is non-latching but the fire voltage detection circuit includes a fire indicator which is latched when a fire signal is detected for longer than a predetermined time. The circuit for latching is controlled by an accumulation circuit in the control panel that controls a relay closing that generates a fixed voltage suitable for the fire indicator.

7 Claims, 3 Drawing Figures

FIRE DETECTOR

The present invention relates to fire detector apparatus which utilizes an accumulation-type fire control panel.

BACKGROUND OF THE INVENTION

In fire detection apparatus the accumulation-type control panel is designed for the purpose of preventing a false fire alarm from being produced by transient fire phenomena, and gives a fire indication or alarm only if it has decided that a fire detector has been continuously detecting a fire phenomenon exceeding a predetermined fire detection level for a predetermined length of time.

In the case of the accumulation-type control panel which continues the accumulating operation without resetting the fire detector, however, it is not practicable to use a conventional fire detector having a latching function for the following reason. The conventional latching fire detector, once having detected a fire phenomenon (e.g., heat, smoke, light from flame, gas) exceeding the predetermined fire level, keeps its fire signal transmission circuit (or the circuit which controls the signal transmission circuit) activated and continues transmitting the fire signal even if the fire phenomenon disappeared immediately after the initial detection. Therefore, the accumulation-type control panel, if connected with such a latching fire detector, has the drawback that it operates on the transient fire phenomenon as well and produces a false fire alarm.

Accordingly, it is preferable to connect a non-latching type fire detector to an accumulation-type control panel. The non-latching type fire detector outputs the fire signal only while the fire phenomenon is exceeding the predetermined fire level and stops outputting the fire signal as soon as the fire phenomenon falls below the fire level.

When the accumulation-type control panel is connected to a plurality of non-latching type fire detectors, each equipped with a response indicator lamp to indicate that the fire detection part is active, there is the new problem that one cannot know which fire detector initiated the fire signal to operate the accumulation-type control panel because the response indicator lamp is lit only while the fire detector is outputting the fire signal, and goes off as generation of the fire signal is stopped.

SUMMARY OF THE INVENTION

To solve the above problem, a fire detection system in accordance with the invention includes a non-latching fire detecting element in combination with an accumulation-type control circuit and a latching circuit able to latch the associated fire indicating element to an "ON" state upon receipt of a control signal generated when the accumulator circuit has determined that the fire phenomenon being detected has persisted at above the prescribed level for a predetermined period of time.

A variety of accumulator circuits are available. In a preferred embodiment, the accumulator circuit is an electronic circuit that includes an integrator for determining the length of time of a fire signal is being received. Alternatively, the accumulator circuit may utilize a timer for this purpose.

A variety of ways are available for transmitting the control signal to be used for latching the fire response indicator to the "ON" state after the accumulator circuit has determined that a fire signal of the predetermined length has been received. In a preferred embodiment, the accumulator circuit is made to close a relay which activates a zener diode and drops the voltage applied to a voltage detecting circuit sufficiently that a thyristor is turned on which latches the fire detector in the "ON" state until reset.

In particular, fire detection apparatus in accordance with the invention comprises non-latching fire detecting means for detecting a fire phenomenon of above a predetermined level, fire signal transmission means controlled by the fire detecting means for transmitting a fire signal when such a fire is being detected, means supplied with the fire signal and including means for accumulating the fire signal, means for setting off a fire alarm when the fire signal has been continuously detected for a predetermined length of time, fire indication means having an "ON" state for visual indication of a fire signal, and control signal means responsive to the accumulating means for latching the fire indication means in the "ON" state after the fire signal has been continuously detected for said predetermined length of time so that the fire indication means persists in that state until reset.

DETAILED DESCRIPTION OF THE INVENTION

Figure 1:
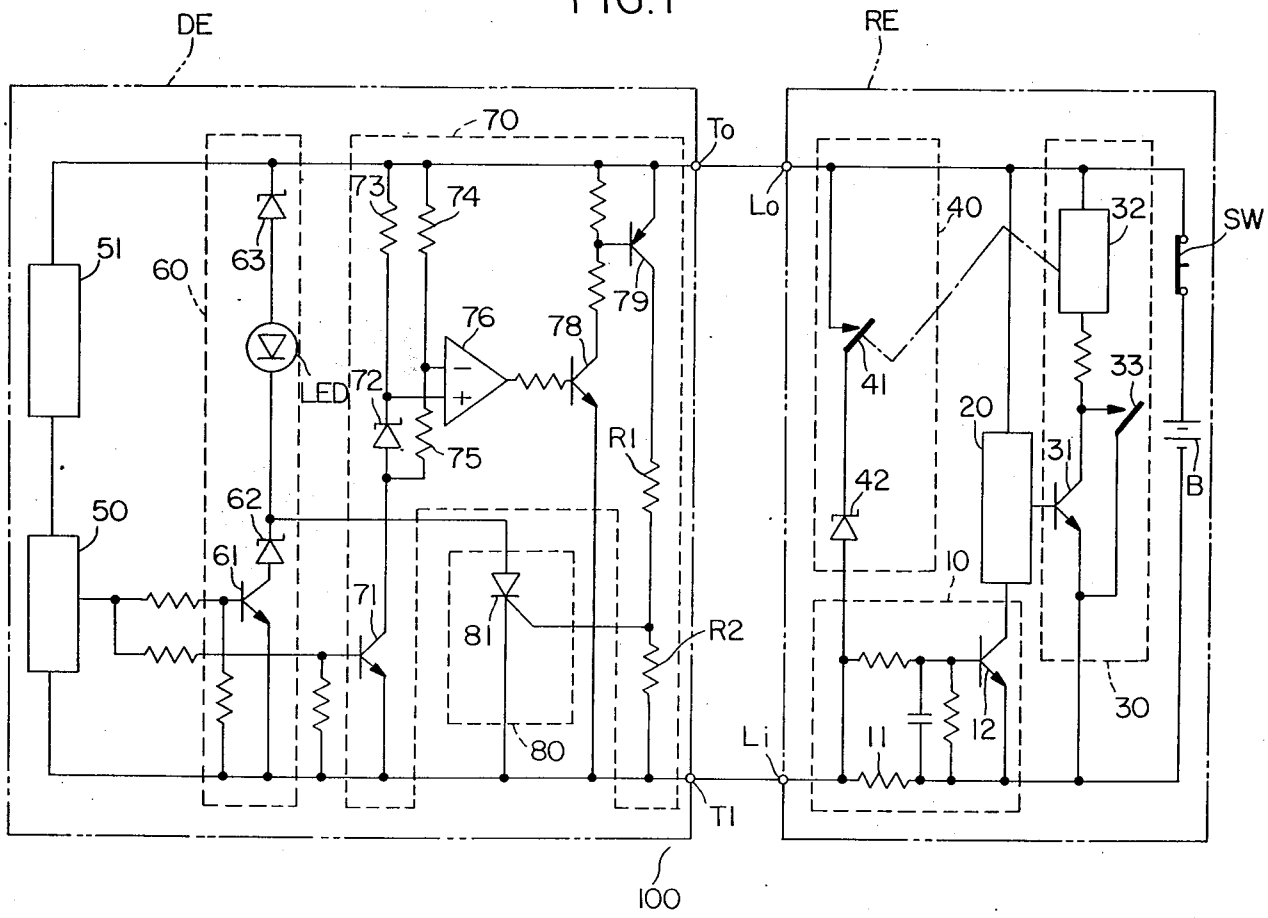
FIG. 1 is a schematic partly in circuit form and partly in block form of a fire alarm system in accordance with one embodiment of the invention.

With reference now to FIG. 1, the fire detection system 100 is composed of an accumulation-type control panel RE, a fire detector DE, and power and signal lines Lo, Li, which connect the accumulation-type control panel RE with the fire detector DE.

The accumulation-type control panel RE is a control panel which produces alarms in case it has received a fire signal continuously for a predetermined length of time, and is equipped with a fire signal detecting circuit 10, an accumulation circuit 20, an alarm circuit 30, a voltage dropping circuit 40 useful as a control signal transmission means, a power supply B generating a voltage of about 24V, and a reset switch SW.

The fire signal detecting circuit 10 is a circuit which detects the fire signal transmitted from the fire detector DE, and is equipped with a resistor 11 connected in series with the signal lead Li from the fire detector DE, and controls a transistor 12 which switches on when the voltage drop across the resistor 11 has reached a predetermined voltage.

The accumulation circuit 20 is a circuit which operates when the above-mentioned fire signal has been accumulated for a predetermined length of time, and is composed of an integration circuit or a timer.

The alarm circuit 30 is a circuit which depends on operation of the accumulation circuit 20 and is composed of a transistor 31, a relay 32 to operate a fire alarm lamp, indicator lamps, an alarm bell, and such which are not shown on the drawing, and a make contact 33 of the relay 32.

The voltage dropping means 40 is a circuit which causes the voltage applied as control signal across the power and signal lines Lo and Li to drop when the alarm circuit 30 has operated, and is equipped with a make contact 41 of the relay 32 and a zener diode 42 which serves as a voltage regulator of about 8 V.

The fire detector DE is equipped with a fire detecting element 50, a voltage stabilizing circuit 51, a fire signal transmission circuit 60, a response indicator lamp LED, a voltage detecting circuit 70 as a control signal receiving means, and a self-holding or latching circuit 80.

The fire detecting element 50 is a device which detects one or more fire phenomena and comprises one or more sensors responding to heat, smoke (ionization, scattered-light, light obscuration, etc.), radiation or gas, and a detecting part discriminating whether or not the output of the sensor has reached a predetermined level.

The fire signal transmission circuit 60 is a circuit which transmits a fire signal to the accumulation-type control panel RE while the fire detecting element 50 is operating. By dropping the voltage across the input and output terminals To, Tl to the first predetermined voltage (e. g. 18 V), which change has insignificant influence upon normal operation of the fire detecting element 50, the detection of a fire signal is transmitted to the fire control panel RE. The fire signal transmission circuit 60 supplies current to flow through the resistor 11 in the fire signal detecting circuit 10 via the power supply and signal lines Lo, Li when the fire detecting element 50 has operated. Ihe fire signal transmission circuit 60 is equipped with a transistor 61, zener diodes 62, 63 and a response indicator lamp LED. The response indicator lamp LED, serving as operation indicating means, indicates that the fire detecting element is in operation detecting a fire signal.

The voltage detecting circuit 70 is a circuit which detects a voltage drop applied as a control signal to the terminals To, Tl caused by the voltage dropping circuit 40 in the accumulation-type control panel RE, and is equipped with a bridge circuit comprising a transistor 71, a zener diode 72 and resistors 73, 74, 75, a comparator 76, transistors 78, 79, and voltage dividers R1, R2.

The latching circuit 80 is a circuit which after actuation by operation of the voltage detecting circuit 70 as a result of the accumulation of a fire signal for the required period of time, latches to a fixed state. It basically comprises the thyristor 81, preferably of the type known as a silicon-controlled rectifier (SCR). When the latching circuit has latched, the fire response indicator lamp LED is kept lit, until the system is reset by the reset switch SW.

Operation of the system is as follows.

Assuming that a voltage of 24 V is available from the power supply B, and no fire phenomenon has developed, only a small supervisory current flows through the fire detector DE. Therefore, the supply voltage of approximately 24 V is maintained across the input and output terminals To and Tl of the fire detector DE through the power and signal lines Lo, Li.

When the fire detecting element 50 has detected a fire phenomenon of the predetermined level, the transistor 61 switches on and the response indicator lamp LED lights, indicating that the fire detecting element 50 is in the operating mode. At the same time, the fire signal transmission circuit 60 including the zener diodes 62, 63 becomes conductive, allowing current to flow through the resistor 11 in the fire signal transmission circuit 10. In this case, despite the voltage drops due to the flow of current, a sufficient voltage (the first predetermined voltage, e.g. 18V) for the fire detecting element 50 to continue fire surveillance is still applied across the input and output terminals To, Tl (2 V of the 18 V are applied to the voltage stabilizing circuit 51, and the remaining 16 V are applied to the fire detecting element 50).

As current flows through the resistor 11 in the accumulation-type control panel RE (i.e., a fire signal has been generated) as described above, the transistor 12 switches on and the accumulation circuit 20 starts accumulating. If the fire signal is generated for a predetermined length of time, the accumulation circuit 20 operates and the transistor 31 switches on. As a result, the relay 32 is actuated to operate either one or more of a fire alarm lamp, an indicator lamp or an alarm bell (which are not shown on the drawing). At the same time the make contact 41 of the relay 32 in the voltage dropping circuit 40 closes, causing the voltage applied to the input and output terminals To and Ti to decrease down to a voltage (the second predetermined voltage, e.g. 8 V) that is determined by the zener diode 42 as a control signal.

Within the fire detector DE, the transistor 71 remains switched on as long as the fire detecting element 50 is detecting fire, and thus the bridge circuit comprising the zener diode 72 and the resistors 73–75 remains energized. The comparator 76 is designed to output no "High" signal in the case of the first predetermined voltage. However, as the voltage across the input and output terminals To, Tl drops to the second predetermined voltage, as in the above-mentioned case, the voltage on the non-inverting terminal of the comparator 76 becomes higher than that on the inverting input terminal, and thus the comparator 76 outputs a "High" signal. This acts to make the transistors 78, 79 switch on, and the resultant increase in the gate voltage of the thyristor 81 causes the thyristor 81 to latch on and keep the response indicator lamp lit.

Since the response indicator lamp LED remains lit both while the fire detecting element 50 is in operation, and also after the accumulation-type control panel has completed accumulation and the thyristor has latched, it is possible to confirm which one of numerous fire detector elements in the same zone has caused the accumulation-type control panel to operate. Moreover, the response indicator lamp LED does not falsely operate on transient fire phenomena, because the accumulation circuit 20 of the accumulation-type control panel RE does not operate on transient fire phenomena. Moreover, so long as the voltage across the input and output terminals To, Tl does not drop to the above-mentioned second predetermined voltage, the thyristor 81 does not turn on, and operation of the response indicator lamp LED does not latch on.

To reset the response indicator lamp LED of the fire detector DE, in other words operation of the latching circuit 80, the reset switch SW needs be set in the "Off" position. In this case, current flowing through the thyristor 81 decreases below the holding current, and the thyristor 81 turns off.

While the response indicator lamp LED serves both as the accumulation response indicating means and as means to indicate the operating mode of the fire detecting element 50 in the above embodiment, a second indicator lamp may be provided as the accumulation response indicating means and arranged in such a manner that the thyristor 81 is connected with the input and output terminal To via the second indicator lamp. Alternatively, for the operation indicating means, a mechanical device such as a magnetic indicator plate may be used in place of the indicator lamp.

It is also possible separately to provide a third signal line and a terminal to feed the second predetermined voltage, when generated in the control panel RE, to the fire detector DE, and an AND means as control signal receiving means to detect input of the second predetermined voltage and generation of the fire detection signal through the third signal line so that the thyristor 81 may turn on when the AND means has operated.

Figure 2:
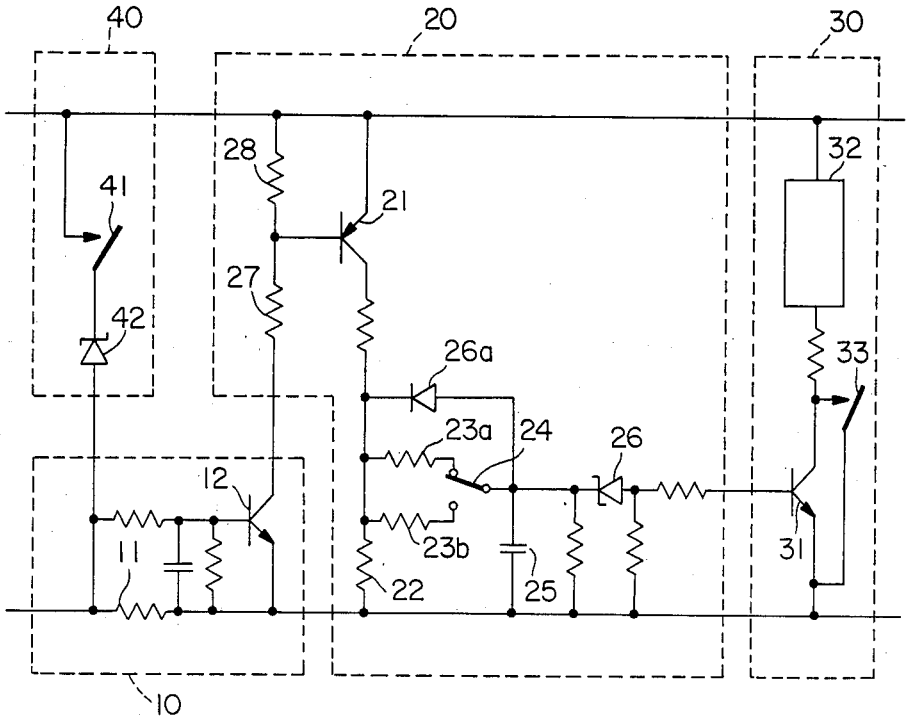
FIG. 2 is a schematic partly in circuit form and partly in block form of a special form of accumulation-type control panel suitable for substitution in the system of FIG. 1.

FIG. 2 is a circuit diagram of a control panel which includes a form of accumulation circuit 20 that has the advantage of permitting easy change of the time necessary for the fire signal to be detected before the alarm is sounded and the indicator lamp is latched on.

In this figure and FIG. 1, the corresponding elements have the same reference numbers.

The accumulator circuit 20, comprises the transistor 21 which switches on when the transistor 12 switches on in response to a fire signal and permits current to flow through resistors 22A and 22B. The current flow through transistor 21 supplies the integration circuit comprising the resistor 22B, 23*a* and 23*b*, the capacitor 25, diode 26*a* and the changeover switch 24. The position of the changeover switch is used to choose between resistors 23*a* and 23*b* for its connection in series with capacitor 25 to fix the time constant of the integrator circuit. The diode 26*a* is connected across the chosen one of the resistor 23*a*, 23*b* and is poled to discharge the capacitor 25 when it no longer is accumulating charge.

When the transistor 21 switches on, a predetermined voltage is developed across the resistor 22B that is connected in the collector branch of transistor 21. This voltage gradually charges the capacitor 25, which is across resistor 22B and the chosen one of resistors 23*a* or 23*b*. When the voltage accumulated on capacitor 25 exceeds the zener voltage of the zener diode 26, which is connected between the switch 24 and the base of transistor 31 in the alarm circuit 30, the transistor 31 switches and turns on the alarm 32. As previously mentioned, diode 26*a* will quickly discharge capacitor 25 if the fire signal no longer is being received and transistor 21 stops conducting.

Alternatively, in lieu of an electronic accumulation circuit of the kind described, there may be substituted a timer which generates an output when continuously supplied with an input for a prescribed period of time and which clears itself when the input continues for less than the prescribed time.

Figure 3:
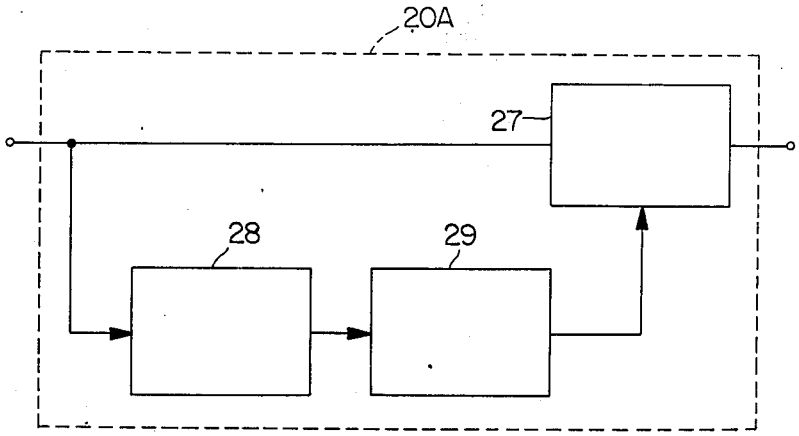
FIG. 3 is a block schematic of another form of accumulation circuit for use in the system of FIG. 1.

In FIG. 3 there is depicted a block schematic of a form of accumulator which is controlled by a fire detector when generates a series of pulses rather than a continuous signal as a fire phenomenon is being detected. Such a fire detector might comprise a smoke detector which flashes a series of pulses so long as a fire phenomenon is being detected. The accumulator 20*a* includes a counter 27 which counts each pulse received from the fire detecting circuit 10 and generates an output when a prescribed number, for example fifteen, are counted.

Also supplied by the fire detecting circuit 10 is a triggerable monostable multivibrator 28 designed to have an output signal whose duration length is longer than one repetition period of the fire signal pulse but shorter than two repetition periods. Therefore, the monostable multivibrator continues its output so long as signal pulses are being periodically received.

The output of multivibrator 28 is used to supply the Schmitt trigger 29 which generates an output at the trailing edge of any pulse received from the multivibrator 28, which output can be used to clear the counting of counter 27 when an insufficient number of pulses have been counted to set off the alarm.

It should be apparent that still further modifications are feasible in the basic detection system described.

In particular, there are a variety of other ways to communicate to the detector panel from the control panel that the accumulator has accumulated a fire signal of sufficient duration to latch to the lighted state the appropriate indicator lamp. For example the control signal transmission circuit 40 might be designed to transmit as the control signal a pulsed signal or a signal of a specific frequency in which case the control signal detection circuit in the detector panel would be modified appropriately to respond to this form of transmitted control signal rather than to a voltage drop across the input-output terminals to the panel.

I claim:

1. Fire detection apparatus comprising non-latching fire detecting means for detecting a fire phenomenon of above a predetermined level, fire signal transmission means controlled by the fire detecting means for transmitting a fire signal when such a fire is being detected, means for receiving the fire signal and including: means for accumulating the fire signal, means for setting off a fire alarm when the fire signal has been continuously detected for a predetermined length of time, fire indication means having an "ON" state for visual indication of a fire signal, and control signal means responsive to the accumulating means for latching the fire indication means in the "ON" state after the fire signal has been continuously detected for said predetermined length of time so that the fire indication means persists in that state until reset.

2. Fire detection apparatus in accordance with claim 1 in which the fire indication means is also responsive to the fire signal transmission means so as to assume the "ON" state so long as a fire signal is being transmitted.

3. Fire detection apparatus in accordance with claim 1 in which the control signal means includes means activated by the accumulating means for establishing a predetermined voltage which serves as a control signal for latching the fire indication means.

4. Fire detection apparatus in accordance with claim 3 in which the accumulating means activates a relay, the closing of which establishes the predetermined voltage which serves as the control signal for latching a thyristor for controlling the fire indication means.

5. Fire detection apparatus in accordance with claim 4 in which the fire indication means is also responsive to the fire signal transmission means so as to assume the "ON" state so long as a fire signal is being transmitted.

6. A fire detection apparatus comprising a fire detection panel including a nonlatching fire detection means for detecting a fire phenomenon above a predetermined level, fire signal transmission means controlled by the fire detecting means for transmitting a fire signal when such a fire is being detected, and means for visually indicating a fire phenomenon, and a voltage detection circuit including means for latching the fire phenomenon indicating means "ON" upon receipt of an appropriate signal by the voltage detection circuit, and a control panel including means supplied with the transmitted fire signal for accumulating the fire signal, means for setting off a fire alarm when the fire signal has been continuously detected for a predetermined period of time, and control signal means responsive to the accumulating means for developing a control voltage signal when the fire signal has been continuously detected for the predetermined period of time and for transmitting said control voltage signal to the voltage detection circuit in the fire detection panel whereby said indicating means is latched to the "ON" state until reset.

7. The apparatus of claim 6 in which the control signal means includes a relay which is activated by the accumulating means and whose closing establishes a predetermined voltage which is transmitted to the voltage detection circuit for latching a thyristor for controlling the fire indicating means.

* * * * *